US008292241B2

(12) United States Patent
Coley et al.

(10) Patent No.: US 8,292,241 B2
(45) Date of Patent: Oct. 23, 2012

(54) APPARATUS TO STORE A CHILD'S POTTY SEAT

(76) Inventors: Sheniece La Rhette Coley, Indianapolis, IN (US); Dalayna Jonite Coley, Indianapolis, IN (US)

( * ) Notice: Subject to any disclaimer, the term of this patent is extended or adjusted under 35 U.S.C. 154(b) by 495 days.

(21) Appl. No.: 12/228,343

(22) Filed: Aug. 12, 2008

(65) Prior Publication Data

US 2009/0212179 A1 Aug. 27, 2009

Related U.S. Application Data

(60) Provisional application No. 61/064,222, filed on Feb. 22, 2008.

(51) Int. Cl.
*A47K 13/06* (2006.01)

(52) U.S. Cl. ..... 248/176.1; 248/146; 248/678; 4/902; 4/237

(58) Field of Classification Search ..... 248/678, 248/146, 176.1; 4/661, 237, 902
See application file for complete search history.

(56) References Cited

U.S. PATENT DOCUMENTS

| | | | | |
|---|---|---|---|---|
| 2,568,322 | A * | 9/1951 | Cunningham | 4/239 |
| 4,777,672 | A * | 10/1988 | Gebhard et al. | 4/449 |
| 5,161,263 | A * | 11/1992 | Geneve et al. | 4/483 |
| 6,175,968 | B1 * | 1/2001 | Schneider | 4/239 |
| 7,290,296 | B1 * | 11/2007 | Wilson | 4/484 |
| 7,631,370 | B2 * | 12/2009 | Dunn et al. | 4/239 |
| 7,823,228 | B2 * | 11/2010 | Todokoro | 4/239 |

* cited by examiner

*Primary Examiner* — Terrell McKinnon
*Assistant Examiner* — Steven Marsh

(57) ABSTRACT

An apparatus to store a child's potty seat with A design open at the top and front, incorporating multiple means for attaching the device for concealing, and A means to secure a boy deflector shield, and A pedestal to stand the device on.

2 Claims, 3 Drawing Sheets

APPARATUS TO STORE A CHILD'S POTTY SEAT

CROSS REFERENCE TO RELATED APPLICATIONS

This application is based on provisional application Ser. No. 61/064,222, filed on Feb. 22, 2008.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of toilet training children and more specifically to an apparatus to store a child's potty seat.

Potty seats are widely used to toilet train children. They provide a measure of security for the care giver and can boost the confidence of a child learning to use the toilet. While there are a number of manufactures of potty seats, the apparatus of this invention particularly addresses the need to store potty seats. Potty seats are used in homes and often in child care facilities. The apparent lack of a means to store a potty seat that has been used can contribute to an unsanitary environment. Particularly in child care facilities where standards for cleanliness are regulated by the government.

The invention described therein, will provide a means to store a child's potty seat that is more sanitary than methods that are currently being used. It will also allow for a more convenient and if desired, more discrete means of storing a potty seat. This invention relates generally to a child's potty seat used to toilet train, and more specifically, to the need for storage of that device. It is apparent that there needs to be a hygienic, and easy way to store and conceal a child's potty seat. In accordance with the present invention is to provide a means of hygienically storing and concealing a potty seat until it is needed for use.

Briefly stated, a child's potty seat is used to toilet train toddlers. The potty seat, being a separate device from the actual toilet allows for small children to utilize the toilet without falling through the opening in the toilet. A potty seat is a portable device that decreases the size of the toilet seat allowing parent or care givers to train children to use the toilet. Once the potty seat has been used, it can be put away until it is needed again. After a potty seat has been used it needs to be stored. At this time it appears that there is a need for a means to store the device. In the absence of a means of adequate storage, a potty seat may be left lying out in the open when not in use. That being, a seat that has been used and not immediately properly cleaned potentially allows for an unsanitary environment.

BRIEF SUMMARY OF THE INVENTION

The primary object of the invention is To store potty seats of varying sizes.

Another object of the invention is To provide a hygienic method of storage.

Another object of the invention is To be reusable.

A further object of the invention is To be portable.

Yet another object of the invention is To be easy to clean.

Still yet another object of the invention is To be easy to use.

Another object of the invention is To be conveniently concealed.

Another object of the invention is To provide multiple methods of mounting.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus to store a child's potty seat comprising: A rear member open at the top and front and convex at the bottom; a single piece member attached to the rear member from top left to top right comprising a front rim portion traversing the convex portion of the device; the rear member has means for attaching the device and the means to secure a boy deflector shield; the single piece member allows for a strap to be affixed to the outer top portion of both sides for hanging the device and a pedestal comprising a concave midsection to stand the device on.

In accordance with a preferred embodiment of the invention, there is disclosed an apparatus to provide a sanitary means of storing a child's potty seat comprising: A holding device with an elevated rim encompassing the front of the apparatus to prevent leakage and act to secure a potty seat.

In accordance with a preferred embodiment of the invention, there is disclosed an apparatus to provide multiple means to affix and conveniently conceal a child's potty seat comprising: A holding device with a strap to hang the apparatus, two hole openings to attach with screws, and a pedestal to stand the device on.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
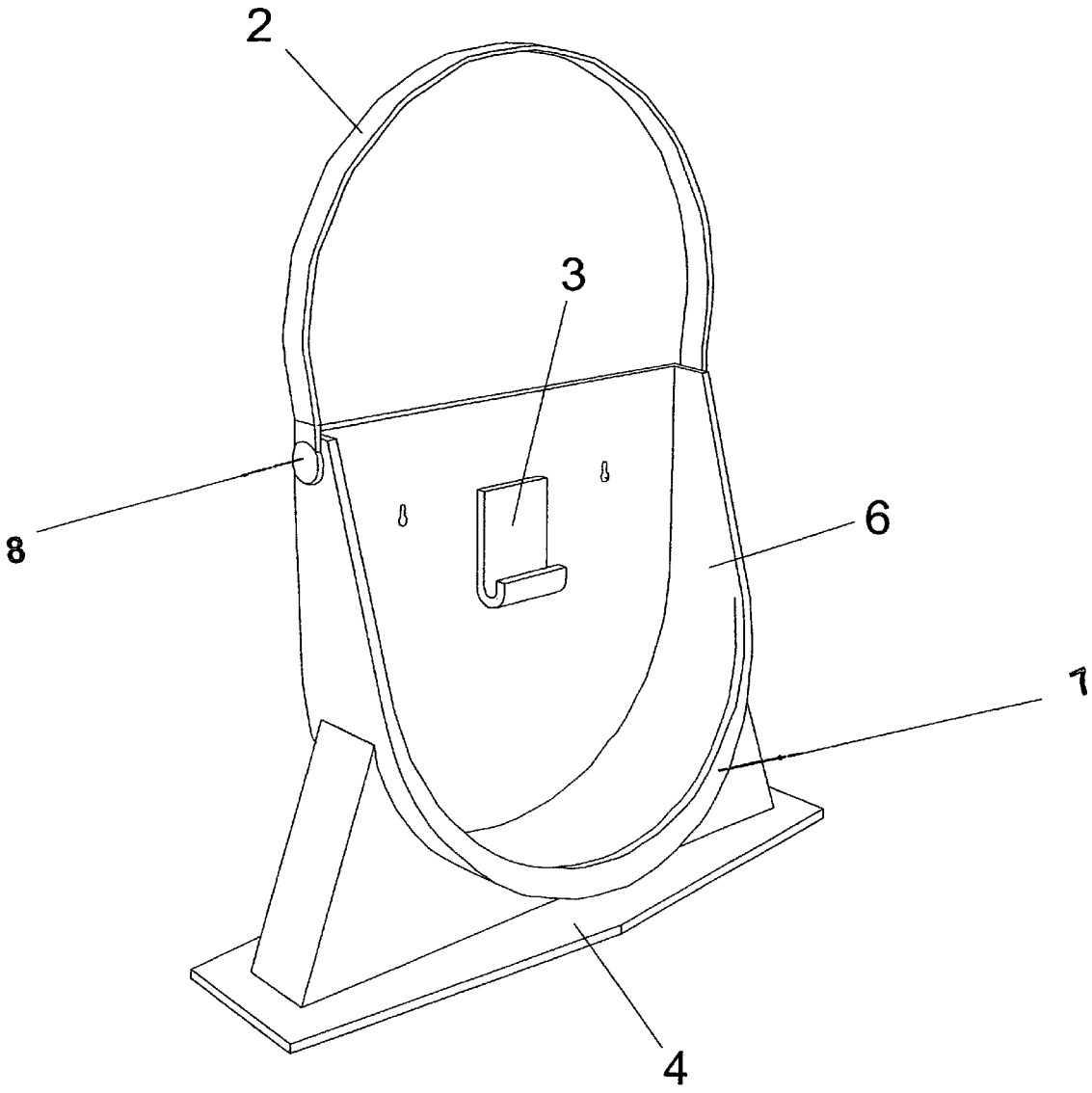
FIG. 1 is a perspective view of the present invention.

Turning first to FIG. 1 which is a perspective view of the holding apparatus there is shown the child's potty seat holder 6 designed to be useful for storing potty seats of varying sizes. In the preferred embodiment, the holder 6 is a single device comprising multiple means of mounting 2, 4, and a hook 3 for storing a deflector shield. The design has an elevated rim 7 encompassing the front of the apparatus. The design allows for ease of use, and hygienic storage as well as the ability to employ multiple methods to mount the device. Additionally, the apparatus provides a place to store a boy deflector shield.

In keeping with one of the principle objects of the invention, the open design of the holder 6 will also provide a more hygienic means of storing a child's potty seat. This is accomplished with the elevated rim 7 that encompasses the front of the apparatus. The rim 7 has been designed to prevent liquid or debris from leaking out. In addition, the rim 7 will provide support that will secure a potty seat ensuring that it will not fall forward out of the holder 6. The device, also being made of a hard material so as to be easy to clean and sanitize.

By way of illustration, the holder apparatus 6 also provides a place to store a deflector shield 3. A boy deflector shield is an additional device provided with most potty seats. It is used to train boys who also sit when learning to use the toilet.

Pursuant to the present invention, provision is made for multiple means to conceal the apparatus. These means are to either use a strap 2 to hang the apparatus by attaching it to 8 protrusion or notches on each side, or a pedestal 4 as a stand. Multiple means of concealing will allow the device to be easy to use and conveniently place out of sight.

Figure 2:
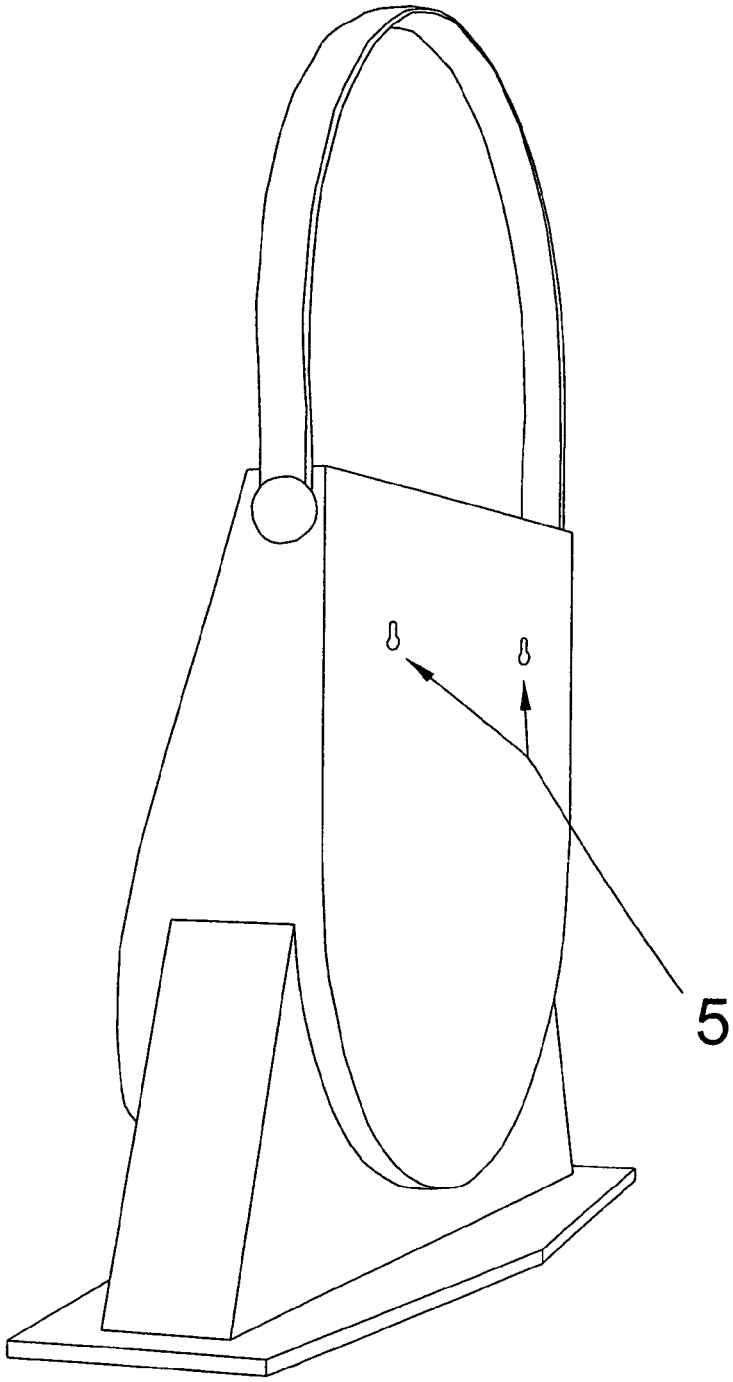
FIG. 2 is a rear view of the apparatus showing an alternate mounting option of the invention.
Figure 3:
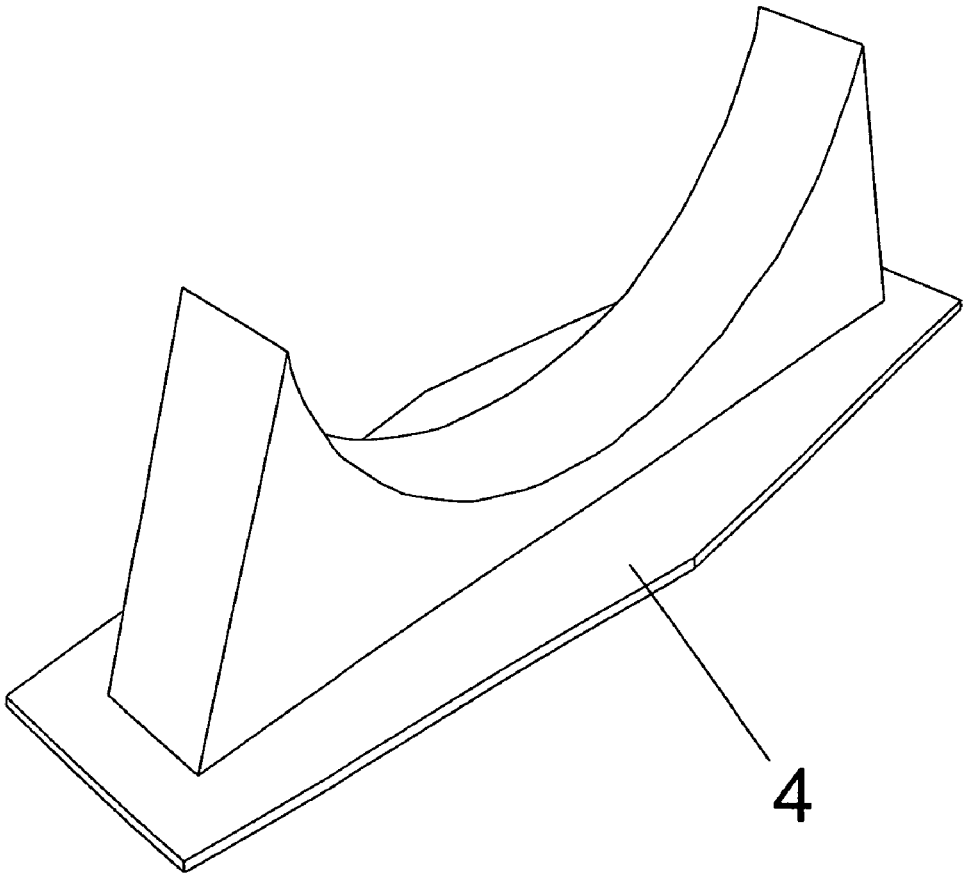
FIG. 3 is a perspective view of the pedestal used as an additional mounting option of the invention.

To accomplish an important function of the invention, there is shown in FIG. 2 and FIG. 3, both displaying the aforementioned multiple means of mounting the apparatus as illustrated in the two hole openings for mounting with screws 5, and the pedestal 4 respectively.

In the present form of the invention, the holder 6 is a one piece apparatus designed with a flat rear, sides that are the same height as the back and convex bottom. The top and front of the apparatus are open. This will allow most standard sized child's potty seats to be inserted from the front of the holder 6. Along the front of the holder 6 is 7 a rim that is elevated. The elevated rim 7 will help to secure a potty seat and prevent liquid and debris from spilling from the holder 6. So that a deflector shield can also be stored, a deflector shield holder 3 has been incorporated into the design facing outward mounted to the rear interior of the holder 6.

For the purpose of providing multiple means of mounting the holder apparatus 6, two holes 5 have been designed into the rear for attaching to a surface with screws. As additional means of mounting, a strap 2 is connected to the holder 6 by means of 8 notches along both sides and a separate pedestal 4 is provided as an option that will allow the holder 6 to be free standing and upright.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

We claim:

1. An apparatus for storing a child potty seat comprising: a rear panel member attached to a single piece member, wherein the rear panel member and the single piece member are each convex at a bottom and open at a top and front, and the rear panel member has two holes for attachment of the apparatus; a strap for hanging the apparatus, wherein the strap is detachable, flexible, and can move forward and backward; wherein the single piece member has notches at a top outer portion of sides of the single piece member for attaching the strap; a rim encompassing the single piece member; a means for storing a boy deflector shield to the rear panel member; and a pedestal comprising a concave midsection to stand the device upon.

2. The apparatus to store a child's potty seat of claim 1 wherein the pedestal has a flat member at the bottom that comes to a point in the front and back.

* * * * *